US005509551A

United States Patent [19]

Terrell, II

[11] Patent Number: 5,509,551

[45] Date of Patent: Apr. 23, 1996

[54] BEVERAGE CONTAINER DISPENSING CAP

[76] Inventor: Robert C. Terrell, II, 10231 NE. Tillamook, #203, Portland, Oreg. 97220

[21] Appl. No.: 271,179

[22] Filed: Jul. 7, 1994

[51] Int. Cl.[6] ..... B65D 55/16

[52] U.S. Cl. ..... 215/229; 215/310; 220/253; 220/709

[58] Field of Search ..... 215/1 A, 100 A, 215/229, 310, 313, 388, 389; 220/705, 709, 253, 714, 715

[56] References Cited

U.S. PATENT DOCUMENTS

| | | | |
|---|---|---|---|
| D. 324,824 | 3/1992 | Hansen | 220/709 X |
| D. 327,848 | 7/1992 | Hanover | 220/709 X |
| 2,815,879 | 12/1957 | Hermes . | |
| 2,844,267 | 7/1958 | Petriccione . | |
| 4,244,477 | 1/1981 | Seel . | |
| 4,852,781 | 8/1989 | Shurnick et al. . | |
| 4,911,315 | 3/1990 | Shrum | 215/229 |
| 5,018,635 | 5/1991 | Whittaker | 220/709 |
| 5,048,705 | 9/1991 | Lynd et al. | 215/1 A |
| 5,071,019 | 12/1991 | Sizemore . | |
| 5,167,354 | 12/1992 | Cohanford . | |
| 5,244,113 | 9/1993 | Stymiest . | |
| 5,328,069 | 7/1994 | Cohanfard | 220/709 X |
| 5,337,918 | 8/1994 | Wang | 220/708 |

*Primary Examiner*—Allan N. Shoap
*Assistant Examiner*—Stephen Cronin
*Attorney, Agent, or Firm*—Marger, Johnson, McCollom & Stolowitz

[57] ABSTRACT

A beverage container dispensing cap assembly designed to replace the standard cap of a conventional beverage bottle. It includes a cap removably attached to the opened end of the beverage container and having a set of continuous interior threads that correspond to exterior threads of the beverage container, a first straw attached to the cap and terminating at a lower end spaced above the floor defined by the container, a second straw mounted on and positioned perpendicular to the cap top and extending upwardly therefrom, a vent assembly mounted in the cap having a closure element adapted to be moved between a first position to permit the flow of air into the bottle and a second position to prevent the flow of air into the container, and the cap top is capable of being moved into a first position such that the first straw is in communication with the second straw allowing liquid to flow from the bottle through the second straw to the first straw and alternatively into a second position forming a water tight seal such that liquid in the bottle cannot flow through the second straw to the first straw, wherein the cap has a sufficient diameter such that the interior threads correspond to the exterior threads of the standard sized circular collar to form a water tight seal between the cap assembly and the opened end of the bottle.

4 Claims, 6 Drawing Sheets

BEVERAGE CONTAINER DISPENSING CAP

BACKGROUND OF THE INVENTION

1. Field of the Invention

This invention relates to dispensing caps for portable beverage containers.

2. Description of the Related Art

A beverage container such as a soft drink or juice bottle is typically accessed by means of a removable cap. Such caps are well known devices for providing an opening in the top of the bottle near the rim through which the contents of the bottle can flow. One obvious drawback to providing such an opening is the possibility of spilling the contents of the bottle because of carelessness or while transporting the bottle while walking or driving a car. Workers in the field attempted to solve this problem by developing portable beverage containers that included a projecting straw. The contents of typical soft drink or juice bottles were transferred into such containers having a projecting straw. Such containers are used in a variety of environments and situations to provide a convenient method for storing and consuming a liquid beverage. The usefulness of these containers particularly extends to bicyclists, hikers, joggers and others in the pursuit of recreational, athletic and other outdoor activities. There are several drawbacks to containers of this type: transferring the beverage from the container it was purchased in to a different container is time consuming, wasteful of the original container, and in the case of carbonated beverages, the transference expends carbonation which causes the beverage to "go flat" more quickly.

In the mid 1970's, the beverage bottling industry began responding to consumer demand for resealable beverage containers by including on its larger, multi-serving bottles a threaded terminal end with a resealable threaded cap. This design was so popular that the industry began using it on smaller, single-serving bottles as well. In the mid 1980's, when the bottling industry began making bottles out of both glass and plastic, it arrived at a standardized "screw cap" bottle opening which is currently used on both returnable and non-returnable beverage bottles of all sizes. This standardized opening is comprised of terminal ends with circular collars and standard threads made to fit a resealable threaded cap.

U.S. Pat. No. 5,167,354 to Cohanford attempts to overcome the need to transfer the beverage to a different container. Cohanford describes a cover which attaches directly to a conventional bottled beverage by means of a threaded cap which matches the bottle's original cap and may be screwed on in its place. Cohanford additionally includes a plastic sheath which matches the curvature of the bottleneck and provides a surface to which a carrying strap may be attached in a several ways. The Cohanfard patent is effective but has one major drawback: the design must be adapted to fit the various curvatures of different sizes and shapes of bottles. While the collar and thread size of the beverage bottles am independent of the shape and size of the bottle, the shape of the bottle neck varies widely. Thus, as Cohanfard teaches at column 6, lines 48–50, many different shapes and sizes of Cohanfard's cap would be needed to fit all the various sizes and shapes of bottled beverages even though they all have standard sized collars and threads.

Thus, a need remains for a new and improved dispensing cap which overcomes the obstacles encountered by workers in the field. Accordingly, it is the object of this invention to provide such a dispensing cap.

SUMMARY OF THE INVENTION

The present invention is a beverage container dispensing cap assembly designed to replace the standard cap of a conventional beverage bottle having at its upper terminal end a standard sized circular collar that includes a set of exterior threads. It includes a cap removably attached to the opened end of the bottle and having a set of continuous interior threads that correspond to the exterior threads of the circular collar for removably attaching the cap to the opened end of the bottle, a vent assembly mounted in the cap having a closure element adapted to be moved between a first position to permit the flow of air into the bottle and a second position to prevent the flow of air into the bottle, and a straw extending through and mounted on the cap and terminates at a lower end spaced above a floor defined by the bottle, wherein the straw extends upwardly beyond an upper surface of the cap wherein the cap has a sufficient diameter such that the interior threads correspond to the exterior threads of the standard sized circular collar to form a water tight seal between the cap assembly and the opened end of the bottle.

In an alternative embodiment, I disclose a beverage container dispensing cap assembly, including a cap removably attached to an opened end of a beverage container bottle having a circular collar with exterior threads, the cap having a set of continuous interior threads that correspond to the exterior threads of the collar and forming a water tight seal between the cap and the collar of the bottle; a cap top movably attached to an upper surface of the cap; a first straw attached to the cap and terminating at a lower end spaced above a floor defined by the bottle; a second straw mounted on and positioned perpendicular to the cap top and extending upwardly therefrom; and means for moving the cap top into a first position such that the first straw is in communication with the second straw allowing liquid to flow from the bottle through the second straw to the first straw and alternatively for moving the cap top into a second position forming a water tight seal such that liquid in the bottle cannot flow through the second straw to the first straw.

A preferred embodiment of the present invention includes a beverage container dispensing cap assembly designed to replace the standard cap of a conventional beverage bottle having at its upper terminal end a standard sized circular collar that includes a set of exterior threads. It includes a cap removably attached to the opened end of the bottle and having a set of continuous interior threads that correspond to the exterior threads of the circular collar for removably attaching the cap to the opened end of the bottle; a first straw attached to the cap and terminating at a lower end spaced above a floor defined by the bottle; a second straw mounted on and positioned perpendicular to the cap top and extending upwardly therefrom; a vent assembly mounted in the cap having a closure element adapted to be moved between a first position to permit the flow of air into the bottle and a second position to prevent the flow of air into the bottle; and means for moving the cap top into a first position such that the first straw is in communication with the second straw allowing liquid to flow from the bottle through the second straw to the first straw and alternatively for moving the cap top into a second position forming a water tight seal such that liquid in the bottle cannot flow through the second straw to the first straw. The cap has a sufficient diameter such that the interior threads correspond to the exterior threads of the standard sized circular collar to form a water tight seal between the cap assembly and the opened end of the bottle.

The foregoing and other objects, features and advantages of the invention will become more readily apparent from the following detailed description of a preferred embodiment of the invention which proceeds with reference to the accompanying drawing.

DETAILED DESCRIPTION OF THE INVENTION

Figure 1:
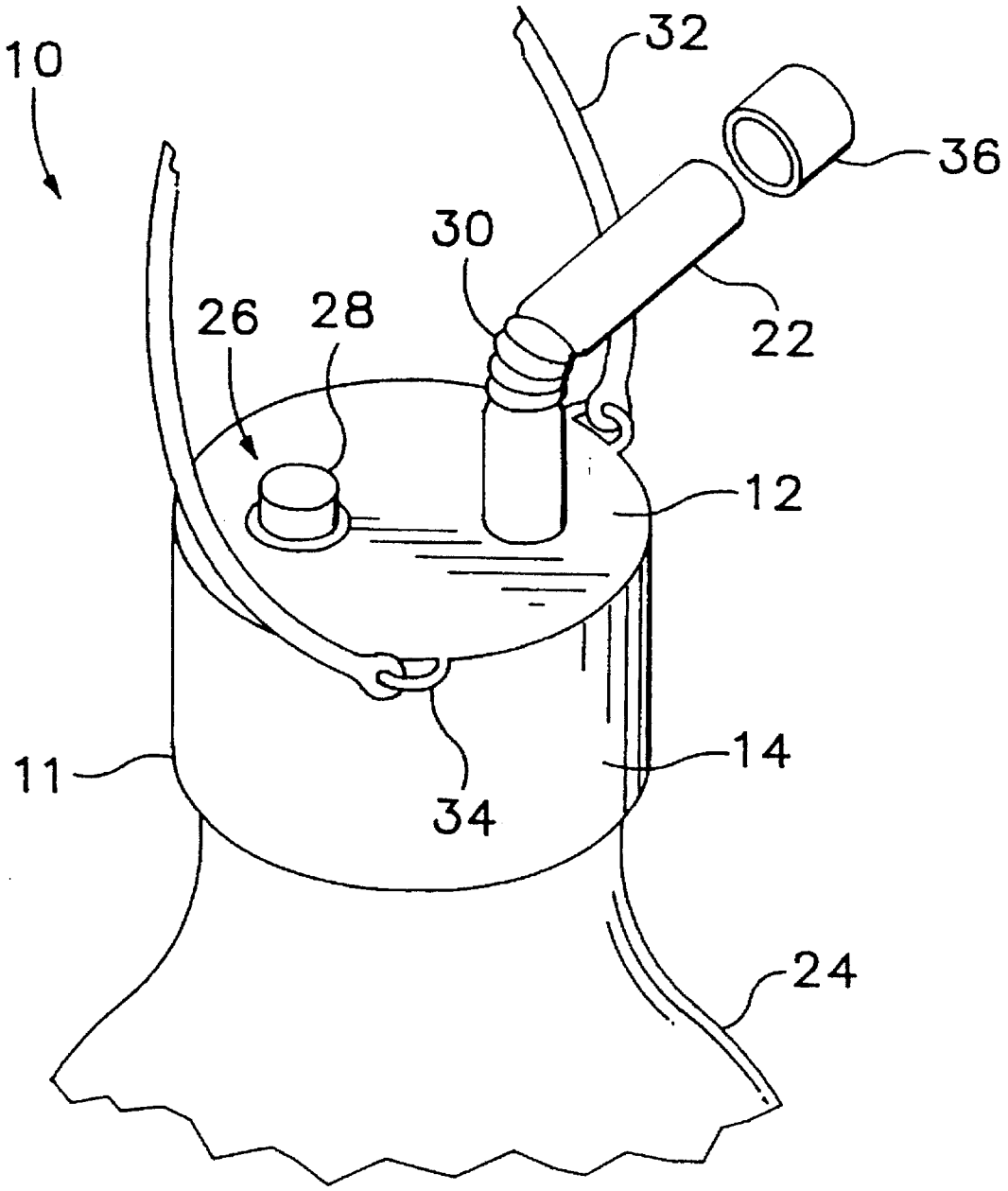
FIG. 1 is a perspective view of the cap assembly in accordance with the instant invention.
Figure 2:
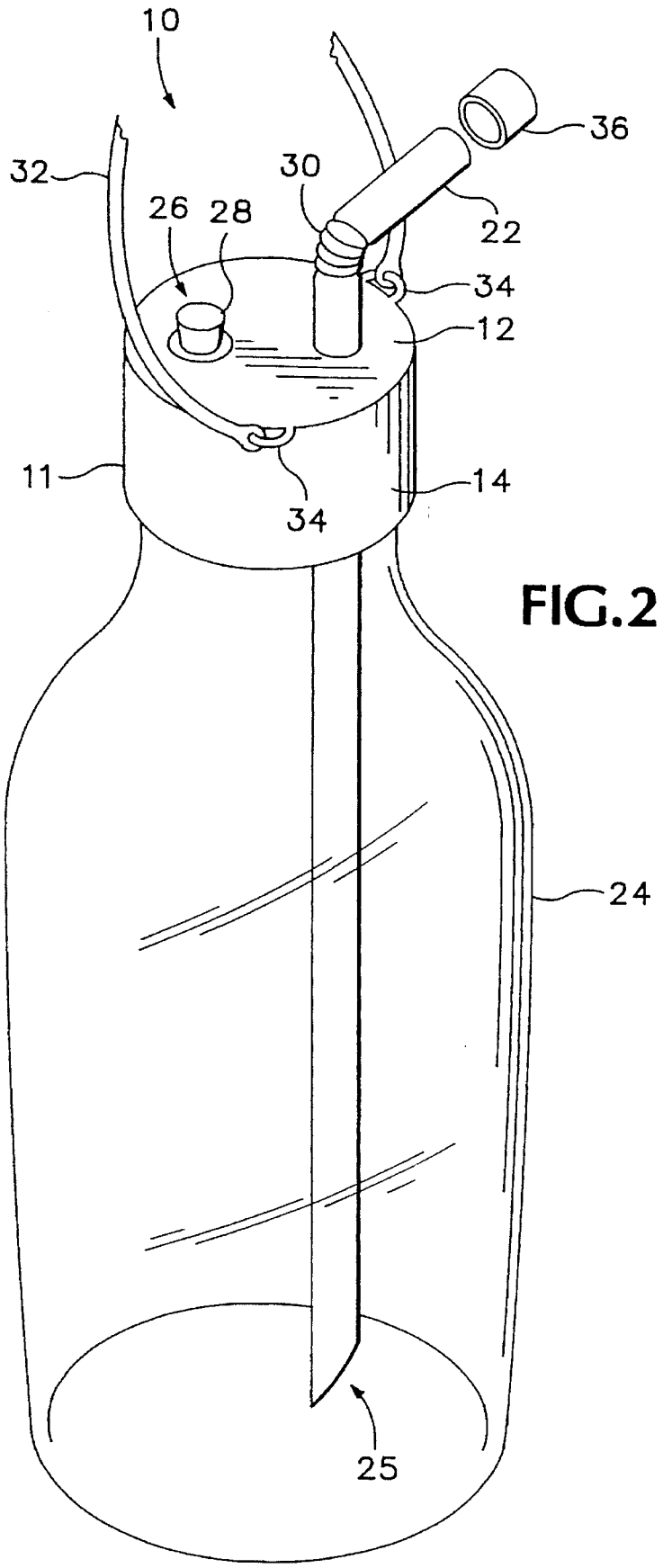
FIG. 2 is an isometric view of the cap assembly of FIG. 1.
Figure 3:
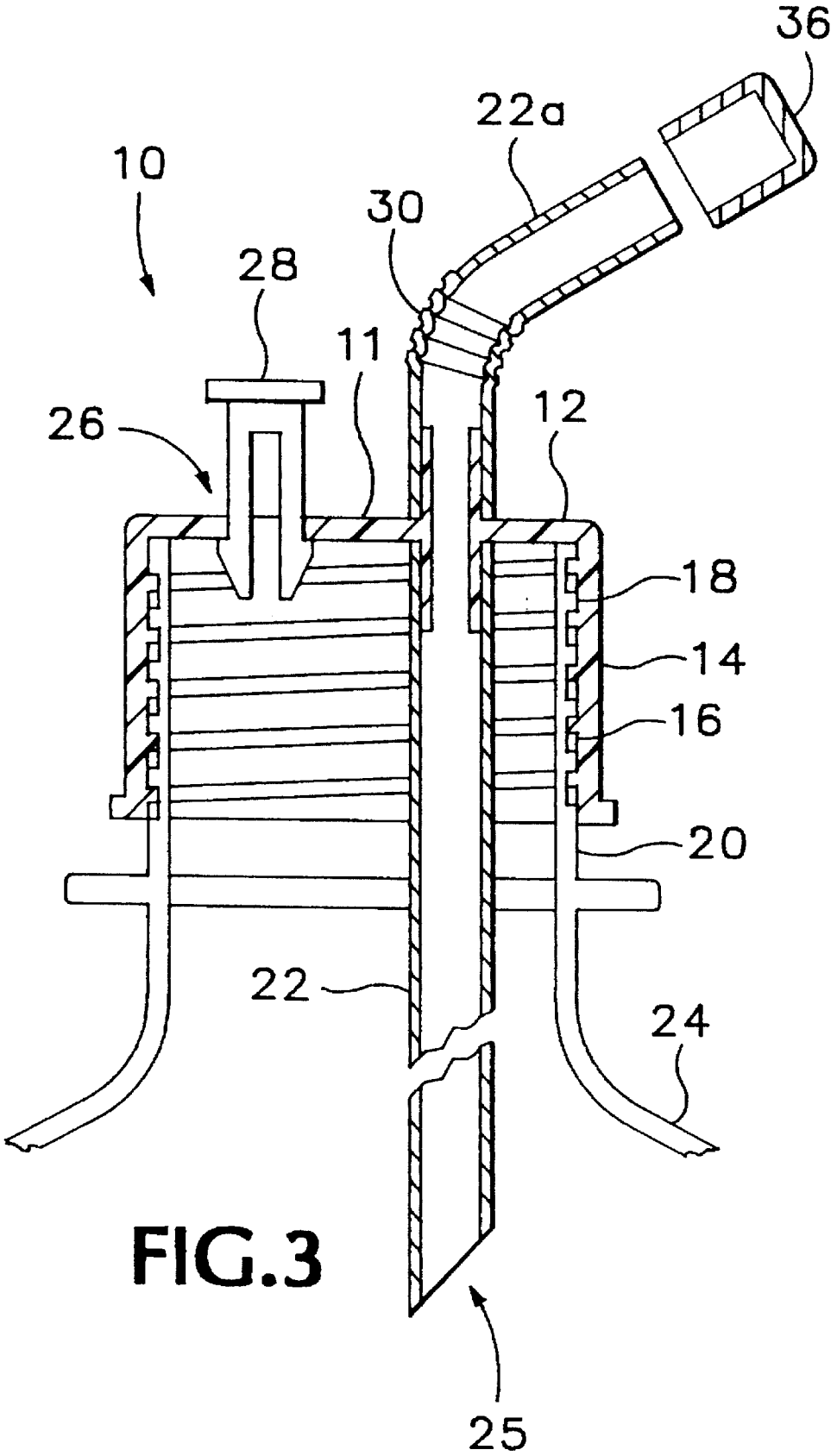
FIG. 3 is a sectional view of the cap assembly of FIG. 2.

Referring to FIGS. 1 to 3, I will now describe a new and improved beverage container dispensing cap assembly embodying the principles and concepts of the present invention and generally designated by the reference numeral 10. More specifically, the assembly 10 essentially comprises a cap 11 of a generally rigid construction and is securable to a collar 20 of beverage bottle 24. Beverage bottle 24 extends orthogonally downwardly and axially displaced from the upper surface 12 for frictionally receiving the assembly 10. Bottle 24 is a typical polymeric beverage container which has a standard sized collar 20 and standard sized threads 18.

Cap 11 has a planar upper surface 12 with an orthogonally downwardly extending skirt 14 orthogonal to the upper surface 12. The skirt 14 includes a continuously threaded interior surface 16 provided with companion threading to the threads 18 of the collar 20. Cap 11 has a sufficient diameter such that threads 18 corresponds to surface 16 to create a water tight seal between cap assembly 10 and collar 20. Preferably, cap 11 has an exterior diameter ranging from about 0.5 to 2.0 inches. More preferably, cap 11 has an exterior diameter of about 1.25 inches.

An integral straw 22 extends through the cap 11 downwardly relative to and spaced above the bottom surface of the beverage bottle 24 enabling an individual to draw the fluid within the bottle 24 through the straw 22. Preferably, straw 22 is slidably attached to cap 11, includes an accordion hinge 30 and has a bevelled distal end 25. Generally, straw 22 has a length ranging from about 4.0 to 12 inches, preferably from about 5.0 to 7.0 inches, and more preferably from about 6.0 to 7.0 inches, and most preferably about 6.5 inches in length.

Cap assembly 10 also includes a vent assembly 26, which can be for example molded as a part of cap 11 which prevents the overflow of carbonated beverages out of beverage bottle 24. Vent assembly 26 has a closure element 28 which may be moved between a first position pulled up an away from the cap 11 to permit the flow of air into the bottle 24 and prevent the formation of a vacuum within the container when the beverage is being removed via the straw 22 and a second position with the closure element 28 pushed down and towards the cap 11 to prevent the flow of into the bottle 24 and thus sealing bottle 24. In the case of bottles having non-carbonated beverages as contents, when the cap assembly 10 is securely fitted onto bottle 24 and the closure element 28 is closed, a vacuum is created in the bottle and leakage caused by accidental spills will be substantially reduced.

For storage of carbonated beverages, a stopper 36 may be mounted at the upper end of the straw 22 to prevent the loss of carbonation resulting in the beverage going flat. Also, stopper 36 would prevent a fountain effect of the beverage flowing out of the straw if the bottle were shaken.

In a preferred embodiment, cap assembly 10 further comprises a carrying strap 32 which further increases the utility of the present invention. Strap 32 is attached to cap 11 via strap mounts 34 and forms a loop so that the cap assembly 10 while attached to bottle 24 can be held around a person's neck or shoulder. This embodiment is especially useful for joggers and cyclists as well as incapacitated people, who because of a disability or medication, cannot handle a cup or glass. If the user is unable to suck the beverage, bottle 24 can be squeezed to deliver the beverage to the user's mouth. Also, strap 32 allows persons with limited hand or arm use to more easily consume beverages.

Figure 4:
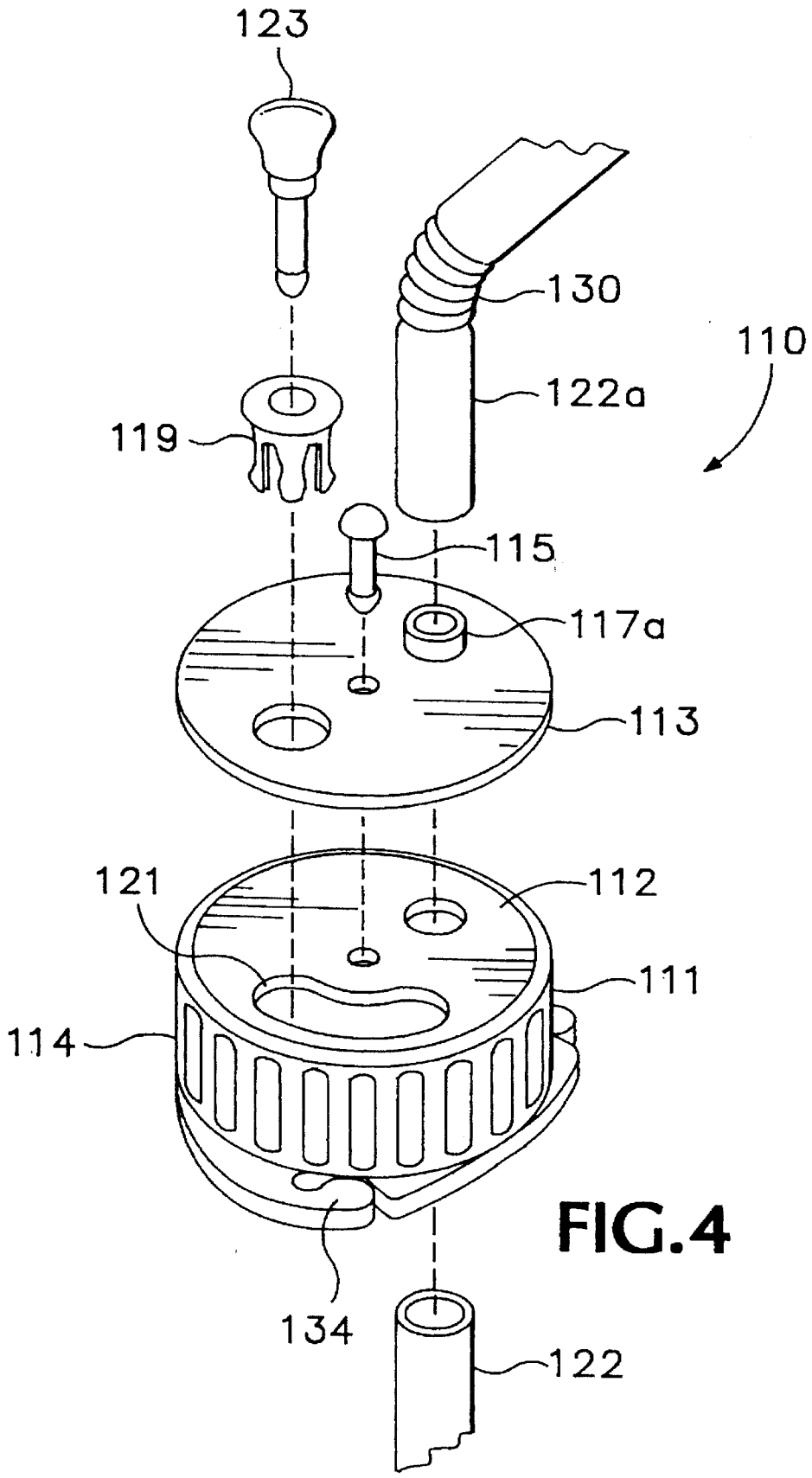
FIG. 4 is an exploded view of an alternative embodiment of the cap assembly in accordance with the instant invention.
Figure 5:
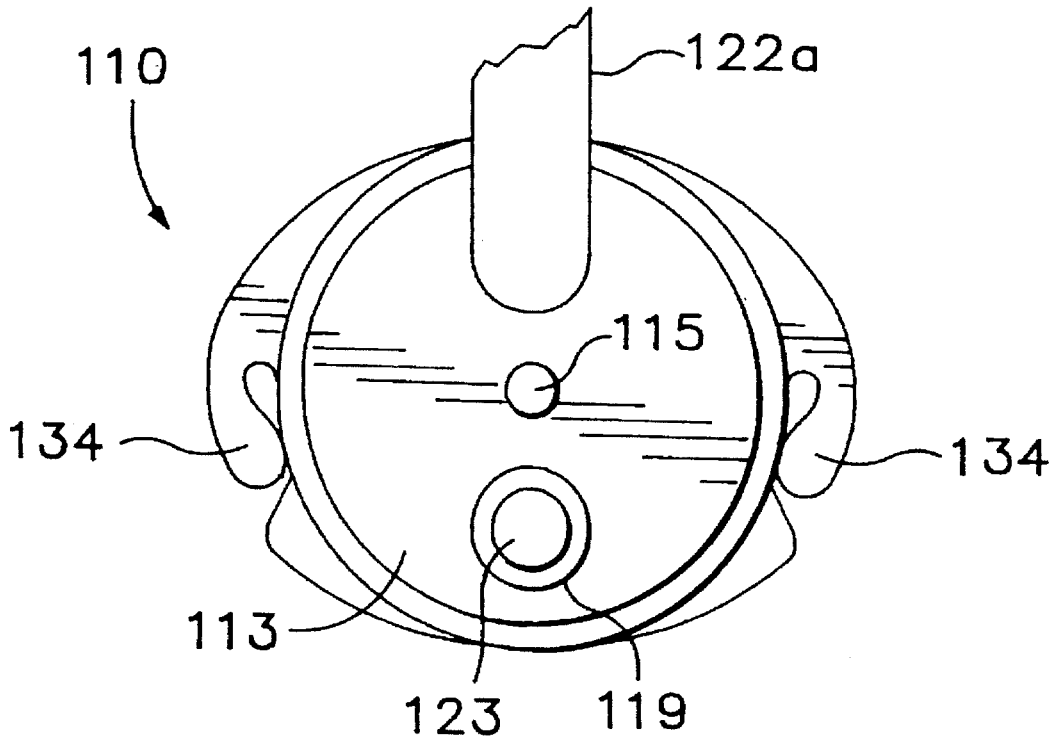
FIG. 5 is a top plan view of the cap assembly of FIG. 4.
Figure 6:
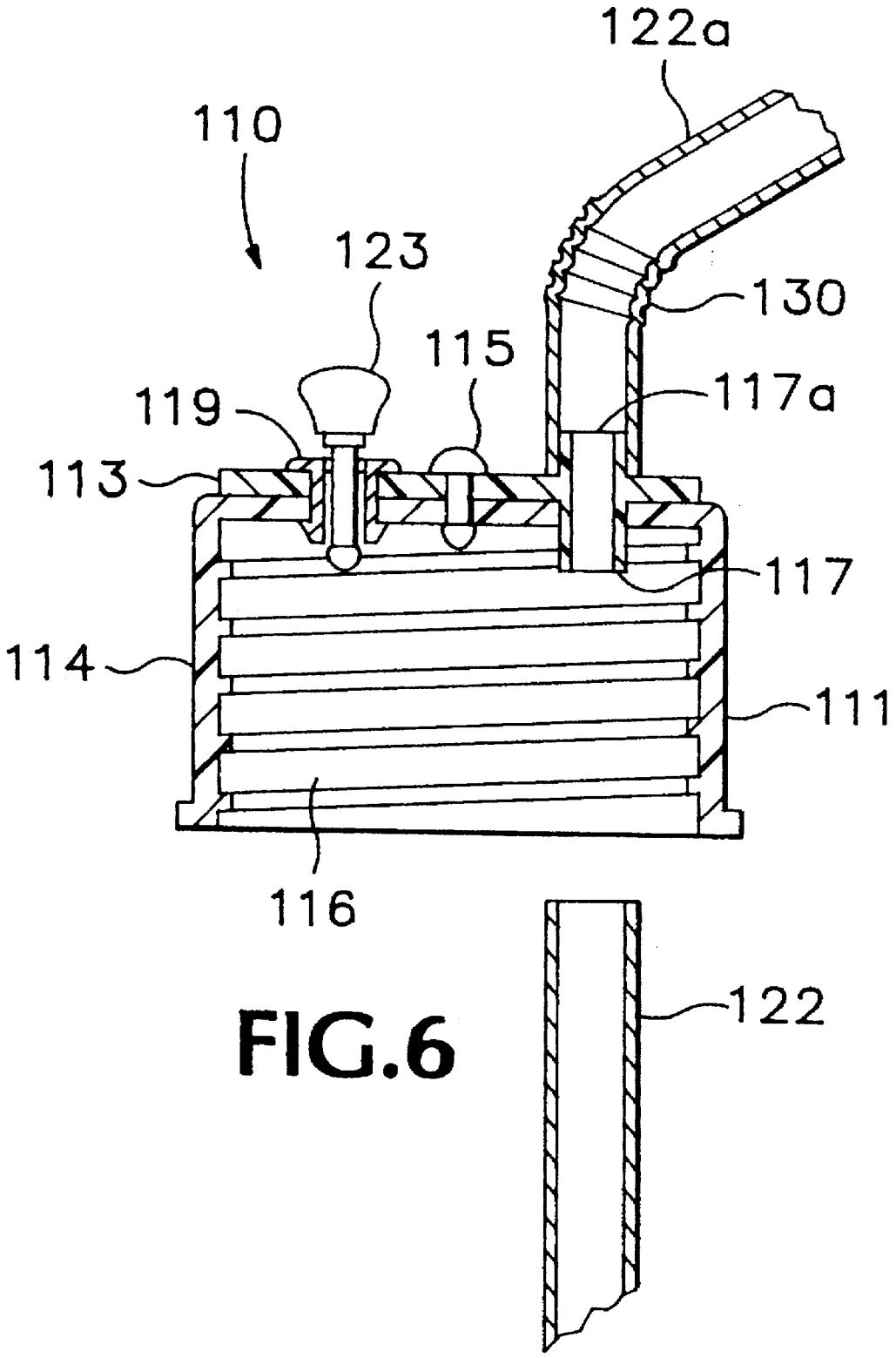
FIG. 6 is a sectional view of the cap assembly of FIG. 5.

FIGS. 4–6 illustrate an alternative embodiment of the invention generally designated by the reference numeral 110. Specifically, a container dispensing cap assembly 110 comprises a cap 111 of a generally rigid construction and is securable to a collar of a beverage bottle (not shown). The beverage bottle extends orthogonally downwardly and axially displaced from the upper surface 112 for frictionally receiving the assembly 110 to form a water-tight seal.

Cap 11 has a planar upper surface 12 with an orthogonally downwardly extending skirt 114 orthogonal to the upper surface 112. The skirt 114 includes a threaded interior surface 116 provided with companion threading to the threads of the collar (not shown). A first straw 122 is attached to the cap 111 via straw lip 117 which extends downwardly from and is positioned orthogonally to the upper surface 112. Straw 122 extends downwardly relative to and spaced above the bottom surface of the beverage bottle.

A cap top 113 is movably attached to the cap 112 by way of fastener 115. Fastener 115 extends through the center of cap top 113 and the upper surface 112 and thereby allows rotation of cap top 113 about its center axis. A second straw **122*a* is attached to cap top 113 via straw lip 117*a*, extending orthogonally from cap surface 113, to form a water-tight seal therebetween. Optionally, straw 122*a* includes an accordion hinge 130** to allow adjustment of the straw position by the user.

Cap assembly 110 also comprises a means for moving the cap top 113 into a first position so that the straw 122 is in communication with straw **122*a* to allow liquid to flow from the bottle through the straw 122 to straw 122*a*. In an alternate position, cap top 113 is moved into a second position so that a water-tight seal is formed thus preventing liquid from flowing from straw 122 to straw 122*a*. This is accomplished for example by way of vent breather ring 119 which is orthogonal to and extends through cap top 113 and cap 112 snap-fitting into vent breather opening 121. Vent breather opening 121 is of sufficient size to allow cap top 113 to rotate about fastener 115 approximately a one quarter rotation. Vent plug 123 is removably attached to and extends through vent breather ring 119, cap top 113 and cap 112. When inserted, vent plug 123 snap-fits securely into the base of vent breather ring 119** and creates a watertight seal therebetween.

When cap top 113 is rotated in a clockwise manner about fastener 115, cap assembly 110 is in its closed position. That is, no liquid can flow between straw 122 and straw **122*a*. When cap top 133 is rotated in a counter clockwise manner about fastener 115, cap assembly 110** is in its open position.

That is, liquid can be drawn by the user from the bottle through straw 122 to straw 122*a* to the mouth of the user. Vent plug 123 can be removed to allow liquid to be easily withdrawn from the bottle by the user. Optionally, cap assembly 110 further comprises a carrying strap (not shown) which is attached to cap 111 via strap mounts 134.

In a preferred embodiment, cap assembly 110 comprises a cap of sufficient diameter such that interior threads 116 correspond to the exterior threads of a circular collar of a standard sized conventional beverage bottle as described above.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A beverage container dispensing cap assembly for replacing a threaded cap of a beverage bottle, said assembly comprising:

a cap removably attachable to a bottle of the type having an exterior threaded collar at an upper end thereof, said cap including a set of interior threads engagable with the bottle collar to form a watertight seal;

a venting aperture formed in said cap;

a dispensing aperture formed in said cap;

a cap top rotatably attached to the top of said cap;

a venting hole formed in said cap top, said venting hole being in alignment with said venting aperture when said cap top is rotated to either a first or a second position;

a dispensing hole formed in said cap top, said dispensing hole being in alignment with said dispensing aperture when said cap top is rotated to said first position and being misaligned and substantially sealed when said cap top is in said second position;

a first straw attachable to said cap top and being in communication with said dispensing hole when so attached; and a second straw attachable to said cap, said second straw extending into said bottle and being in communication with said dispensing aperture when so attached.

2. The cap assembly of claim 1 further including a pin located adjacent a central location on the cap top, said pin passing through and attaching together the cap and cap top for rotational movement of the cap top about the pin relative to the cap.

3. The cap assembly of claim 2 wherein the venting aperture formed in said cap has an arcuate elongate shape radially disposed about the pin.

4. The cap assembly of claim 1 further including an upwardly depending first collar enclosing said dispensing hole and received within said first straw to communicate fluid therebetween, and a downwardly depending second collar enclosing said dispensing aperture and received within said second straw to communicate fluid therebetween.

* * * * *

UNITED STATES PATENT AND TRADEMARK OFFICE

CERTIFICATE OF CORRECTION

PATENT NO. : 5,509,551
DATED : April 23, 1996
INVENTOR(S) : Robert C. Terrell, II It is certified that error appears in the above-indentified patent and that said Letters Patent is hereby corrected as shown below:

Column 1, line 58, change "am" to --are--.

Column 4, line 26, change "11" to --110--;

Column 4, line 26, change "12" to --112--.

Signed and Sealed this

Eighth Day of July, 1997

Bruce Lehman

*Attest:*

BRUCE LEHMAN

*Attesting Officer*

*Commissioner of Patents and Trademarks*